US005451781A

United States Patent [19]

Dietrich et al.

[11] Patent Number: 5,451,781

[45] Date of Patent: Sep. 19, 1995

[54] MINI ION TRAP MASS SPECTROMETER

[75] Inventors: Daniel D. Dietrich, Livermore; Robert F. Keville, Valley Springs, both of Calif.

[73] Assignee: Regents of the University of California, Oakland, Calif.

[21] Appl. No.: 330,766

[22] Filed: Oct. 28, 1994

[51] Int. Cl.[6] ..... H01J 49/38

[52] U.S. Cl. ..... 250/291; 250/290

[58] Field of Search ..... 250/291, 290, 292

[56] References Cited

U.S. PATENT DOCUMENTS

| | | | |
|---|---|---|---|
| 3,390,265 | 6/1968 | Llewellyn | 250/41.9 |
| 3,742,212 | 6/1973 | McIver, Jr. | 250/41.9 |
| 3,937,955 | 2/1976 | Comisarow et al. | 250/283 |
| 4,206,383 | 6/1980 | Anicich et al. | 313/362 |
| 4,514,628 | 4/1985 | Frehaut et al. | 250/299 |
| 4,563,579 | 1/1986 | Kellerhals et al. | 250/291 |
| 4,581,533 | 4/1986 | Littlejohn et al. | 250/282 |
| 4,588,888 | 5/1986 | Ghaderi ekt al. | 250/291 |
| 4,668,864 | 5/1987 | Ghaderi ket al. | 250/291 |
| 4,761,545 | 8/1988 | Marshall et al. | 250/291 |
| 4,874,943 | 10/1989 | Spencer | 250/281 |
| 4,931,640 | 6/1990 | Marshall et al. | 250/281 |
| 4,959,543 | 9/1990 | McIver, Jr. et al. | 250/291 |
| 4,982,088 | 1/1991 | Weitekamp et al. | 250/291 |
| 4,990,856 | 2/1991 | Anderson et al. | 324/464 |
| 5,013,912 | 5/1991 | Guan et al. | 250/282 |
| 5,019,706 | 5/1991 | Allemann et al. | 250/291 |
| 5,155,357 | 10/1992 | Hemond | 250/291 |
| 5,233,190 | 8/1993 | Schlereth et al. | 250/291 |

OTHER PUBLICATIONS

G. Gabrielsej et al., Int. J. of Mass. Spec. and Ion Proc., 88 (1989) 319–332.

*Primary Examiner*—Jack I. Berman

*Attorney, Agent, or Firm*—Henry P. Sartorio; L. E. Carnahan

[57] ABSTRACT

An ion trap which operates in the regime between research ion traps which can detect ions with a mass resolution of better than $1:10^9$ and commercial mass spectrometers requiring $10^4$ ions with resolutions of a few hundred. The power consumption is kept to a minimum by the use of permanent magnets and a novel electron gun design. By Fourier analyzing the ion cyclotron resonance signals induced in the trap electrodes, a complete mass spectra in a single combined structure can be detected. An attribute of the ion trap mass spectrometer is that overall system size is drastically reduced due to combining a unique electron source and mass analyzer/detector in a single device. This enables portable low power mass spectrometers for the detection of environmental pollutants or illicit substances, as well as sensors for on board diagnostics to monitor engine performance or for active feedback in any process involving exhausting waste products.

17 Claims, 6 Drawing Sheets

MINI ION TRAP MASS SPECTROMETER

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to mass spectrometers, particularly to ion cyclotron resonance (ICR) mass spectrometers, and more particularly to a miniature ion trap mass spectrometer which combines an electron source, and the mass analyzer/detector assembly in a single device.

Ion formation, trapping, excitation and detection, in the environment of mass spectroscopy, are known techniques. Ion cyclotron resonance (ICR) is a known phenomenon and has been employed in the context of mass spectroscopy. Essentially, this mass spectrometer technique has involved the formation of ions and their confinement within a cell for excitation. Ion excitation may then be detected for spectral evaluation.

Various types of mass spectrometers and components thereof have been developed. For example, U.S. Pat. Nos. 4,588,888 issued May 13, 1986 and 4,668,864 issued May 26, 1987, each to S. Ghaderi et al., disclose a mass spectrometer including a cylindrical magnet enclosing an ICR cell in which sample ions are formed, trapped, excited and detected. U.S. Pat. No. 4,206,383 issued Jun. 3, 1980 to W. G. Anicich et al., discloses a miniature cyclotron resonance ion source using a small C-shaped permanent magnet.

Mass spectrometers which include a rectangular or cylindrical ICR cell disposed within a vacuum chamber, means to apply a static magnetic field in the region of the ICR cell, an electron gun to induce charges on gaseous samples, and means to perform Fourier analysis on the signals induced by the trapped ions in the trap electrodes, are disclosed in U.S. Pat. Nos., 5,233,190 issued Aug. 3, 1993 to F. H. Schlereth et al.; 4,990,856 issued Feb. 5, 1991 to W. A. Anderson et al.; 4,982,088 issued Jan. 1, 1991 to D. P. Weitekamp et al.; 4,931,640 issued Jun. 5, 1990 and 4,761,545 issued Aug. 2, 1988, each to A. G. Marshall et al.; 4,959,543 issued Sep. 25, 1990 to R. T. McIver, Jr. et al.; 4,581,533 issued Apr. 8, 1986 to D. P. Littlejohn et al.; 4,563,579 issued Jan. 7, 1986 to H. Kellerhals et al.; and 3,937,955 issued Feb. 10, 1976 to M. B. Comisarow et al. 5,155,357 issued Oct. 13, 1992 to H. F. Hemond, and 4,514,628 issued Apr. 30, 1985 to J. Friehart et al. disclose miniaturized non-ICR magnetic mass spectrometers.

In addition, U.S. Pat. No. 5,013,912 issued May 7, 1991 to S. Guan et al. discloses a method for reducing the dynamic range of Fourier transform ion cyclotron resonance (FT-ICR) signal generated by the stored wave for inverse Fourier transform (SWIFT) technique. U.S. Pat. No. 4,874,943 issued Oct. 17, 1989 to R. B. Spencer discloses gaseous ions trapped within an analyzer cell of an ICR mass spectrometer which are excited into resonance by a swept radio-frequency (RF) electric field having an envelope of trapezoidal shape. U.S. Pat. No. 3,742,212 issued Jun. 26, 1973 to R. T. McIver, Jr. discloses a method and apparatus for pulsed ICR spectroscopy in which a gas sample within an analyzer cell is ionized by means such as a pulse of an electron beam. U.S. Pat. No. 3,390,265 issued Jun. 25, 1968 to P. M. Llewellyn discloses a spectrometer which employs ICR and energy absorption in mass analysis.

Commercial mass spectrometer systems are available which utilize quadrupole radio frequency (RF) fields to mass analyze the specimen in continuous flow or to trap a sample and expel the ions into an ion detector by ramping the RF fields. Systems are also available which accelerate the ions from the source and pass them through dispersive electrostatic and magnetic elements. The ions are then detected in a separate region where they have been separated in space according to their mass and velocity. Resolution in these systems is achieved at the expense of either efficiency or size. In research laboratories Penning traps have been utilized in precision mass spectroscopy and have achieved a resolution of $\Delta m/m=4\times10^{-10}$ by detecting the ion cyclotron resonance frequency of single (or a few) particles in magnetic fields of up to 8.5 Tesla. See G. Gabrielse et al., Int. J. of Mass. Spec. and Ion Proc., 88 (1989) 319. These fields are produced by superconducting magnets. The ultra high vacuum needed to achieve this resolution is generated using cryogenic pumping. This low temperature environment is also extremely helpful in reducing electronic noise and hence making possible single ion detection. The large apparatus associated with these experiments is associated with the generation and maintenance of the cryogenic environment. Signal strength is improved and magnetic field homogeneity conditions are relaxed if the physical dimensions of the ion trap is minimized. Given that the ions are produced and detected inside the trap, the performance of the mass spectrometer is enhanced if the size is minimized. In addition, these prior systems utilize a separate ion source, mass analyzer and ion detector regions. Thus, there is a need in the art for a room temperature, portable, low power mass spectrometer with integrated electronics which has the capability for detection of environmental pollutants or illicit substances, for example. This need is satisfied by the present invention which provides a mini ion trap mass spectrometer based on the Penning ion trap principles using permanent magnets which will have an ultimate resolution of $10^4$ (at $P=0.5\times10^{-8}$ Torr), wherein power consumption is minimized by the use of the permanent magnets and a unique electron gun, and which combines a unique electron source and mass analyzer/detector assembly in a single unit, thereby drastically reducing to overall system size.

SUMMARY OF THE INVENTION

It is an object of the invention to provide an ion trap mass spectrometer.

A further object of the invention is to provide an ion trap mass spectrometer which combines a unique electron source and mass analyzer/detector in a single device.

Another object of the invention is to provide a miniature ion cyclotron resonance (ICR) mass spectrometer having low power consumption and thus provides portability for use in various applications.

Another object of the invention is to provide an ion trap mass spectrometer which involves Fourier analyzing the ion cyclotron resonance signals induced in the trap electrodes, to thereby detect a complete mass spectra in a single combined structure.

Other objects and advantages of the invention will become apparent from the following description and accompanying drawings. The present invention is a miniature ion cyclotron resonance (ICR) mass spectrometer comprising a cylindrical permanent magnet with a bore extending along the axis of symmetry of the magnet, a thin-walled vacuum chamber fitted within the bore, a Penning ion trap integral with the vacuum chamber, and an electron gun for ionizing the gas sample in the ion trap. An open ended cylindrical trap is utilized, with the trap constructed to include a segmented anode, having excite and detect segments, so as to allow for the use of Fourier transform ICR detection. The trap is provided with a low power, high efficiency electron gun which limits the total power consumption by the trap to less than ½ watt. The mass spectrum of a sample is determined by performing a Fourier analysis of the signals induced in the electrodes by the trapped ions.

The invention provides a portable, low power mass spectrometer with integrated sensors and electronics for the detection of environmental pollutants or illicit substances, and in general forms the basis for sensors which can provide active feedback in any process involving exhausting waste products. These sensors can be employed for on board diagnostics to monitor engine performance. In particular, when the mini ion trap mass spectrometer is used in conjunction with other techniques such as gas chromatography or fluorescent analysis, target identification ambiguities may be removed with simple on board computer algorithms.

The miniature ion trap mass spectrometer operates in the regime between research ion traps which can detect single ions with a mass resolution of better than one part per billion and commercial mass spectrometers requiring ten thousand ions with resolutions of a few hundred. An attribute of the ion trap mass spectrometer of this invention is that the overall system size is drastically reduced by combining a unique electron source and mass analyzer/detector assembly in a single device. In addition, the low power consumption provides a unit for truly portable instruments.

BRIEF DESCRIPTION OF THE DRAWINGS

The accompanying drawings, which are incorporated into and form a part of the disclosure, illustrate an embodiment of the invention and, together with the description, serve to explain the principles of the invention.

FIG. 4 is a partial view of the analyzer/detector assembly of FIG. 3, illustrating internal components thereof.

DETAILED DESCRIPTION OF THE INVENTION

Figure 1:
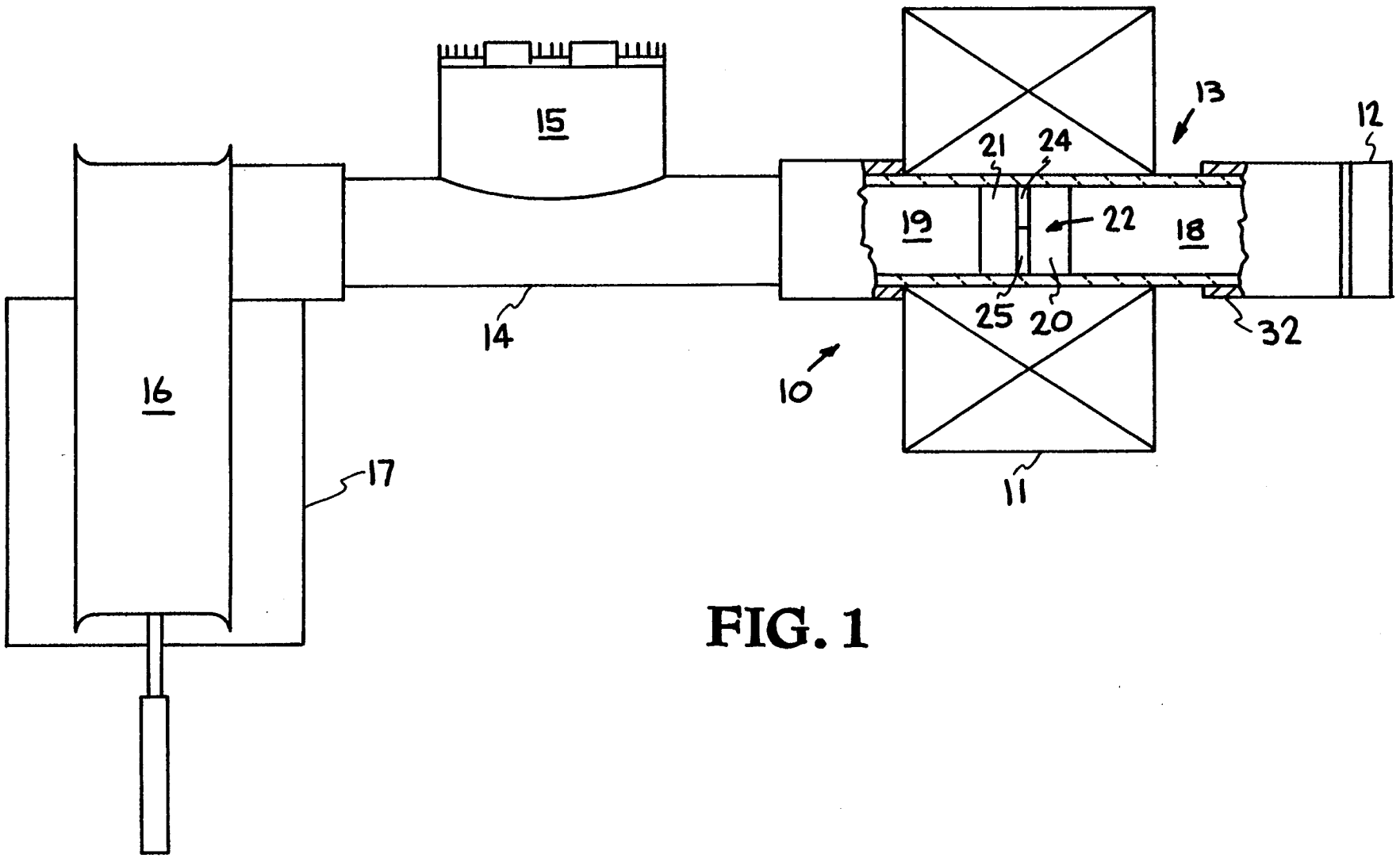
FIG. 1 is a partial cross-sectional view of an overall system, without the computer and analyzer/storage equipment, which incorporates the combined electron source and mass analyzer/detector assembly in a single device in accordance with the present invention.

The invention is directed to a room temperature miniature ion trap mass spectrometer based on the Penning ion trap principles utilizing permanent magnets which will have an ultimate resolution of $10^4$ (at $P=0.5\times10^{-8}$ Torr), and which combines a unique electron gun or source and a mass analyzer/detector assembly in a single device, has low power consumption due to the use of permanent magnets and the unique electron gun design, and by Fourier analyzing the ion cyclotron resonance (ICR) signals inducted in the trap electrodes, it can detect a complete mass spectra in a single combined structure. While systems exist which utilize quadrupole radio frequency (RF) fields to mass analyze the specimen in continuous flow or to trap a sample and expel the ions, these systems have a separate ion source, mass analyzer, and ion detector regions, thus resulting in large overall systems, which are not portable and thus do not have the use potential which is provided by the mini ion trap mass spectrometer of the present invention.

The Penning ion trap mass spectrometer of this invention utilizes a cylindrically shaped permanent magnet with a hole bored in the center along the axis of symmetry. A hollow cylindrical permanent magnet has been designed to optimize the homogeneity in the center of the bore and will produce $\approx$0.44 Tesla maximum field and which has a volume of 4 mm by 2 mm with a homogeneity of $>1:10^4$. The hollow cylindrical permanent magnet utilized in an embodiment of this invention is approximately 1.2 cm high with a 1.5 cm diameter and the hole bored in the center is about 0.7 cm in diameter. Non-cylindrical hollow magnetics may be utilized, but with less effectiveness. Fitted within the central hole in the cylindrical magnet is a thin walled vacuum chamber containing a Penning ion trap. The Penning ion trap is an open ended cylindrical trap design which utilizes Fourier transform analysis to detect trace residual gas in quantities of $<10^{-6}$ std cc/ltr. The trap in this embodiment has upper and lower end electrodes or rings, two compensation electrodes or rings, and a central trapping electrode. The central trapping electrode or anode is segmented (four segments in this embodiment, two excite segments and two detect segments) to allow for detection of the induced charges as the trapped ions undergo cyclotron motion within the trap. The compensation rings can also be segmented and utilized for excitation and detection without a sacrifice in resolution. At one end, at the position where the magnetic field from the permanent magnet goes through zero, a small electron source is fitted. Electrons from this source are pulsed on to ionize the residual gas atoms in the trap. The trap can use a low power, high efficiency tunnel emission cathode which limits the total power consumption by the trap to less than 1 watt. A Spindt electrode or a photo cathode/LED electron source can also be utilized instead of the more conventional filament source. Gas atoms to be sampled are admitted through a small pulsed microvalve to minimize load on the pumping system. Pumping is provided by the most efficient means available. Portable or selfcontained units or systems may be pumped by 8 liter/sec. vac-ion pumps, with initial rough down being accomplished by sorption pumps at a remote site. Units or systems mounted on mobile platforms with self contained power sources may be roughed by internally generated vacuums and brought to good vacuum conditions with a turbo-molecular pump. The cylindrical analyzer/detector assembly or unit is currently fabricated from MACOR ceramic which is then gold (Au) plated internally. MACOR is a well known ceramic manufactured by Coors. The pumping system is integral to the analyzer/detector assembly or unit in that it is connected to the output end or bottom thereof with the unique electron source at the entrance or top thereof. Electron currents are on the order of 2 $\mu$A with a potential of up to 70 volts. The electron source can be readily replaced should it reach the end of its useful lifetime. Also, the mass analyzer/detector assembly can be used with other electron sources, as previously mentioned. Gas inlet is via a fast acting solenoid, 1 ms, which can be cycled at a rate of 100 Hz repetitively. The requisite fast Fourier transform (FFT) boards are fully self contained within a basic analyzer unit housing (not shown) and the pre-amplification circuits are closely coupled to an analyzer assembly. Spectrometer control and data storage/analysis is accomplished with a portable computer. Since these components are well known and conventionally made, illustration of or a detailed description thereof is not deemed necessary. The largest components by weight and volume are the magnet of 0.44 tesla axial field and the ion pump with its required magnets. The system magnet is of neodymium-iron boron (NdFeB) design with an MGOe product of 48. The ion pump magnets are alnico/ceramic, with a field strength of 0.12 tesla and an MGO product of 24. All electronic components are battery operated by two 12v, 2 amp hour rechargeable batteries. This includes the ion pump and the solenoid inlet valve, not shown.

The complete system includes its attendant computer and mass analysis library, not shown. The level of sophistication of the software is tailored to the application, both the control package and the identification libraries. The total package weight is approximately 32 pounds. The dimensions are about 4"×18"×14" for the overall analyzer system and about 2.5"×11"×13" for the computer. The package weight and size diminish with the reduction in mass unit analysis requirements.

The current commercially available portable mass spectrometers are more than a factor of 5 larger in size without the vacuum system and all require 120 v power to operate. Laboratory (research) based units are larger by at least a factor of 10 and again require 120 v power and separate vacuum systems, and are often very difficult to operate, requiring highly trained operators, and interpreting the results requires a Ph.D. level scientist. The miniature Penning trap ion mass spectrometer of this invention however can be very user friendly and in fact can be operated by a single person with only rudimentary knowledge of mass spectroscopy.

Figure 2:
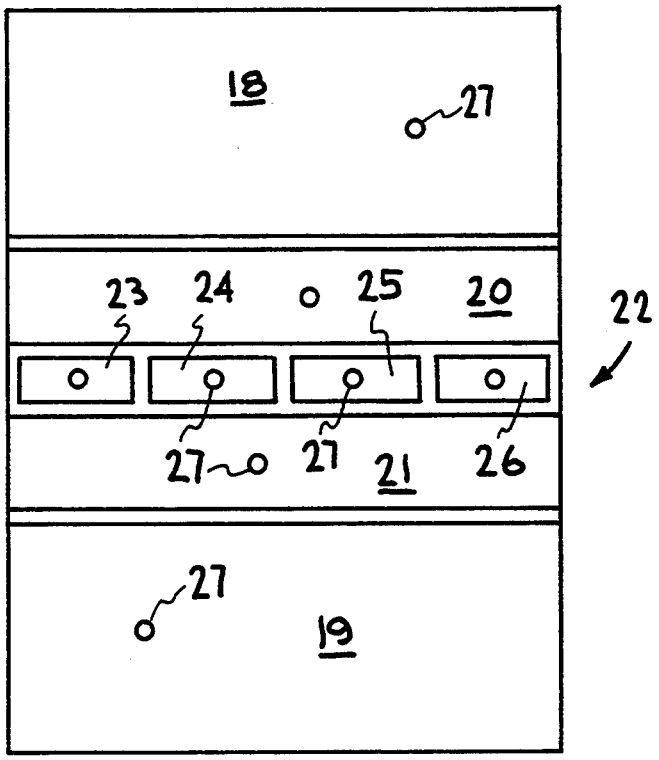
FIG. 2 is an enlarged internal, flattened view of the cylindrical analyzer/detector assembly of the FIG. 1 system illustrating the various components thereof.
Figure 3:
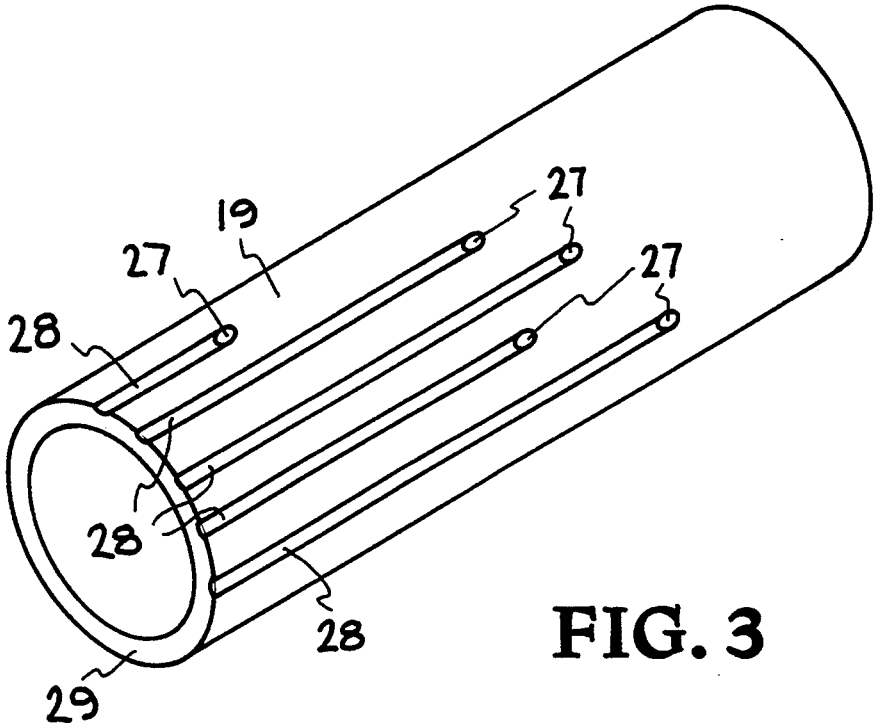
FIG. 3 is a perspective view of the analyzer/detector assembly of FIG. 1, illustrating the grooved electrical leads thereof.
Figure 5:
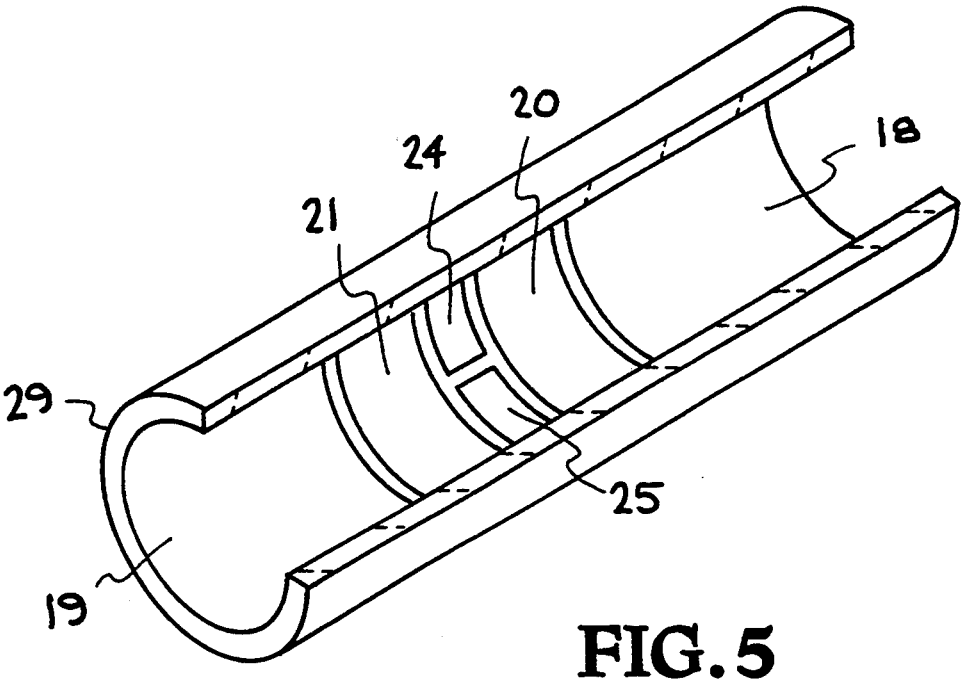

Referring now to the drawings, the ion trap mass spectrometer, minus the computer and associated analysis, storage and power equipment, is schematically illustrated in FIG. 1, with the analyzer/detector assembly or unit thereof being illustrated in greater detail in FIGS. 2–4. As shown in FIG. 1, the system includes an ion mass spectrometer section, generally indicated at 10, having a cylindrical magnet 11 and an electron source, generally indicated at 12, with an analyzer/detector assembly, generally indicated at 13, located within cylindrical magnet 11. The mass spectrometer section 10 is coupled by an isolation tube 14 with a cryogenic pump assembly 15 to an ion pump 16 having installed magnets 17. Inasmuch as the cryogenic pump assembly 15 and ion pump 16 and their function are generally known in the art and are not part of the present invention, other than operating in the system with the ion mass spectrometer section 10, a detailed description thereof is deemed unnecessary. As set forth above, the invention is directed to the ion mass spectrometer section 10 of the FIG. 1 system and includes components 11, 12 and 13, and wherein the electron source 12 and mass analyzer/detector assembly 13 are combined into a single device using a hollow cylindrical magnet 11, and wherein the analyzer/detector assembly 13 is mounted in an opening of the magnet 11. While the analyzer/detector assembly can be used with any suitable electron source, FIGS. 5–10 illustrate an improved electron source or gun. As seen in FIGS. 1–4, the mass analyzer/detector assembly or Penning trap 13 is composed basically of upper (top) and lower (bottom) end electrodes or rings 18 and 19, a pair of compensation electrodes or rings 20 and 21, and a central trapping electrode or anode, generally indicated at 22, which includes four (4) segments 23, 24, 25 and 26, with only two segments 24 and 25 being shown in FIG. 1. The end electrode or cap 18 adjacent the electron source or gun 12 is referred as the top end electrode or ring. The central trapping electrode or anode 22 is segmented to allow for detection of the induced charges as the trapped ions undergo cyclotron motion within the trap assembly.

As shown in FIG. 2, which is a flattened view of the cylindrical analyzer/detector assembly 13, two (2) of the segments, 23 and 25 of central trapping electrode 22 are excite segments and two (2) segments, 24 and 26, are detect segments. However, a greater number of segments may be used. Each of the end cap and ring electrodes 18–19 and 20–21, and the central electrode segments 23–26 are electrically connected to a point of use by leads, lines or wires via openings or contact points 27, and grooves 28, as shown in FIG. 3, which extend from the various contact points 27. As seen in FIG. 4 and described in greater detail hereinafter, the various electrodes and electrode segments are formed on the inner surface of a cylindrical tube 29, which for example is a 1.0 inch diameter MACOR tube, with the electrodes 18–19 and 20–21 and segments 23–26 of electrode 22 being machined into and plated on the internal surface of the tube 29. While not shown, it is to be understood that electrical leads, which may be printed on or deposited in the grooves 28 of FIG. 3 and connected at one end to the electrodes 18–22 via openings or contact points 27, such as by soldering, plating, etc. are connected to a point of use, such as to an associated analyzer/computer arrangement, as known in the art. By way of example, the contact points 27 which extend through the MACOR tube 29 may be of a 0.015 inch diameter with a 0.003 inch gold coating, the grooves 28 in the outer surface of tube 29 may be formed from a radius of 0.062 to 0.070 inch, and the electrical leads to extend along the grooves 28 may be 0.010 inch diameter gold wires or gold plating, and the electrodes 18–22 may include a 600 Å gold coating to provide the necessary electrical connections.

By way of example, the electrodes 18–19, 20–21 and segments 23–26 of electrode 22 of analyzer/detector assembly or unit 13 may be formed from or on a MACOR ceramic tube 29 as follows: A rod of MACOR material is turned to 1.0000 inch outside diameter. The ID is turned to 0.800 inch diameter. Radially placed 0.015" holes are drilled from the OD to the ID. These holes are for the insertion of the electrode wires. Electrode wires are inserted into the 0.015" holes, extending 0.125" into the ID. The wires are fixed into place with silver conductive epoxy. The ID is turned to 0.8110" segment separating grooves, both radial and axial, of 0.0120" width and 0.030" depth are machined into the ID. The ID is machined to 0.8110" along its full length. Axial slots are machined radially on the OD to a depth of 0.015"×0.0625" width starting at the top of the tubulation and ending at the center of the electrode wire. Au is vapor deposited onto the interior surfaces to a depth of 400 Å. The floor of the inside diameter radial and axial grooves are machined to a depth of 0.0005". Au foil of 0.005" thickness ×0.050" width is adhered to the OD axial slots and conductive silver epoxied to its segment wire. The completed assembly is vapor degreased and vacuum baked at 150° C. for 12 hours.

Figure 5:
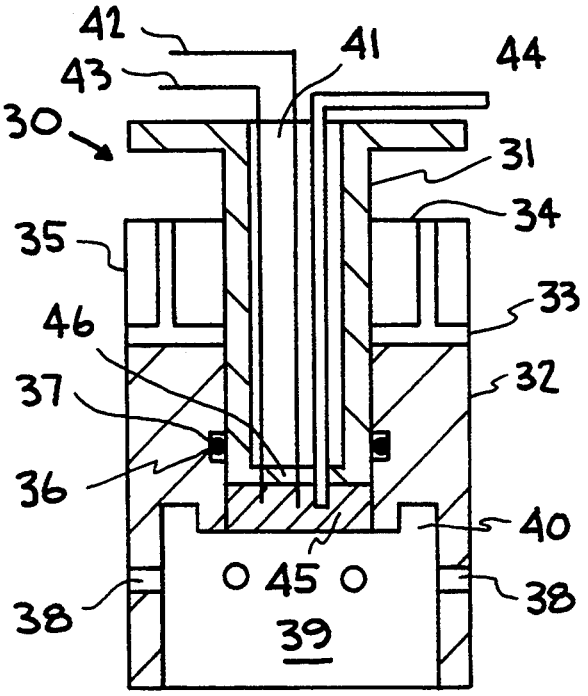
FIG. 5 is a schematic view of an embodiment of an improved electron source or gun made in accordance with the invention and adapted to be mounted so as to combine with the analyzer/detector assembly of FIGS. 2–4.
Figure 6:
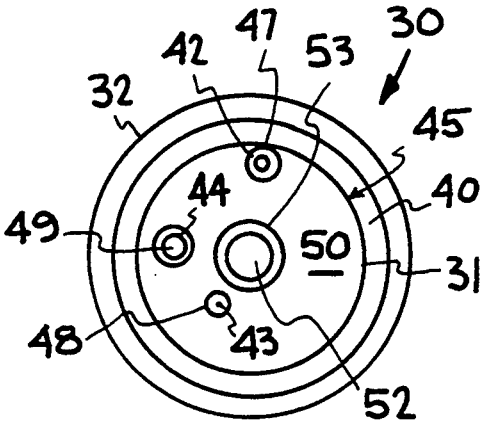
FIG. 6 schematically illustrates an inner end section of the FIG. 5 electron source.
Figure 7:
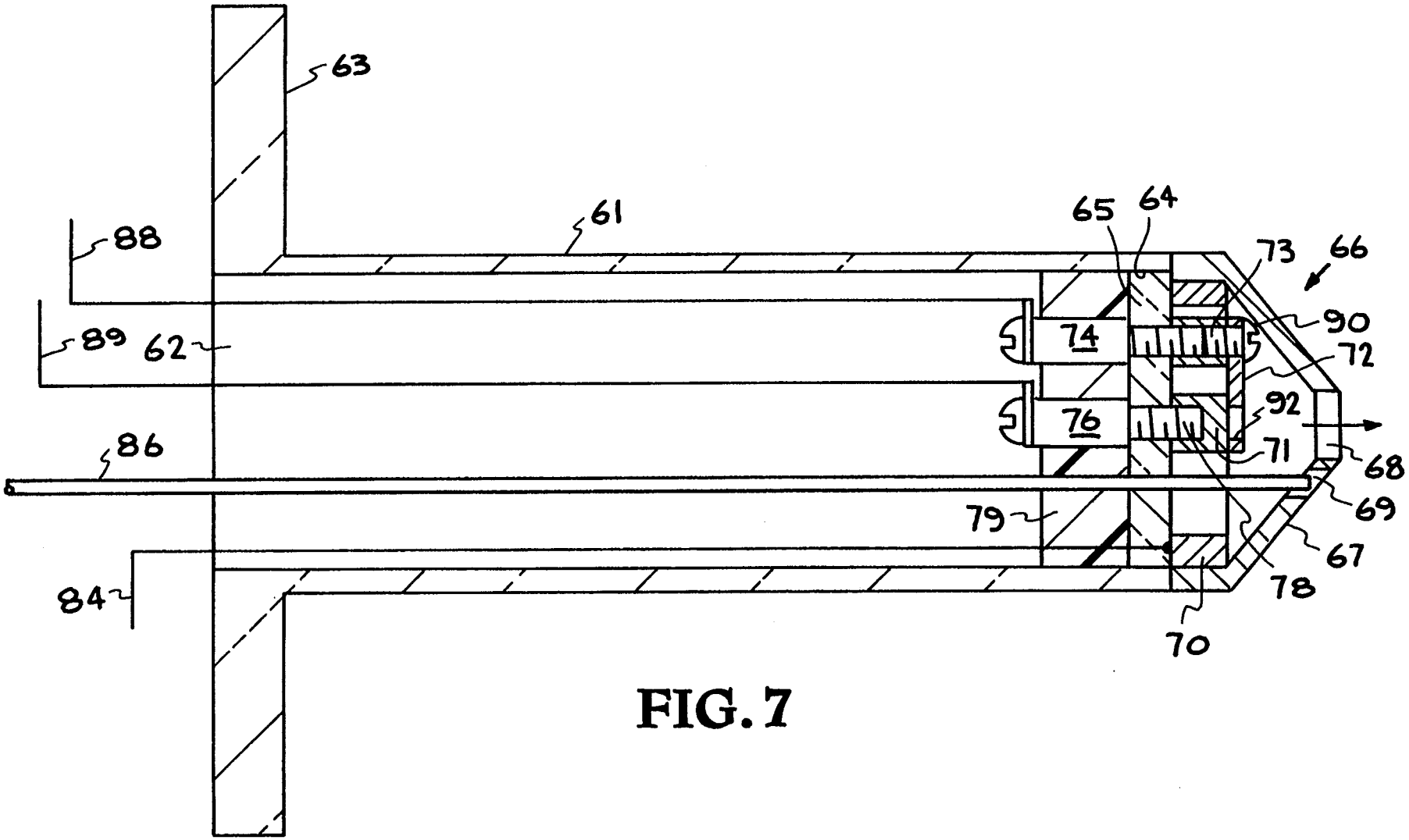
FIG. 7 is an enlarged cross-sectional view of a portion of another embodiment of an improved electron source, illustrating various components thereof.
Figure 8:
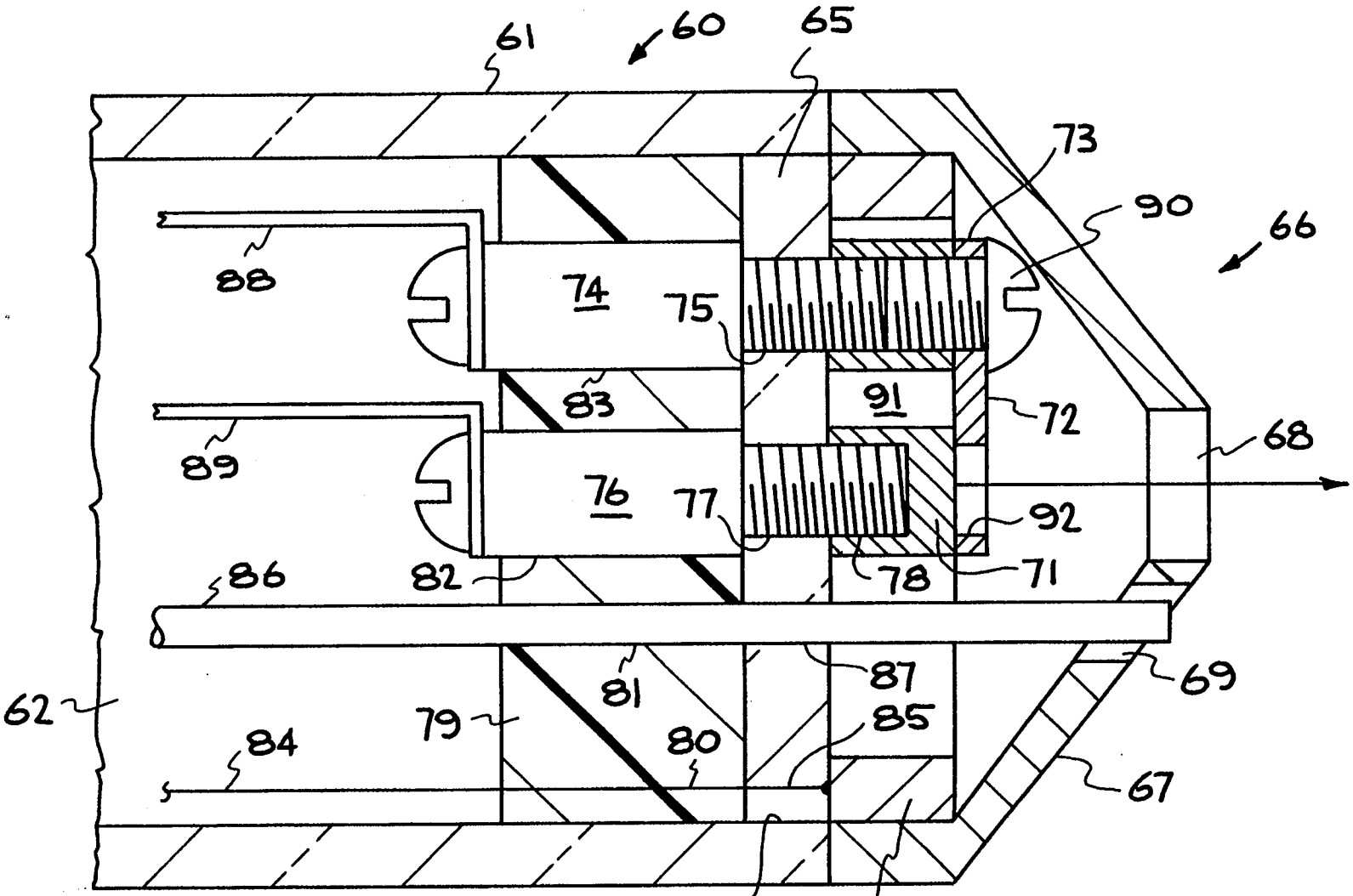
FIG. 8 is an enlarged cross-sectional view of the end section of FIG. 7, illustrating the unique source button and associated components of the electron source.
Figure 10:
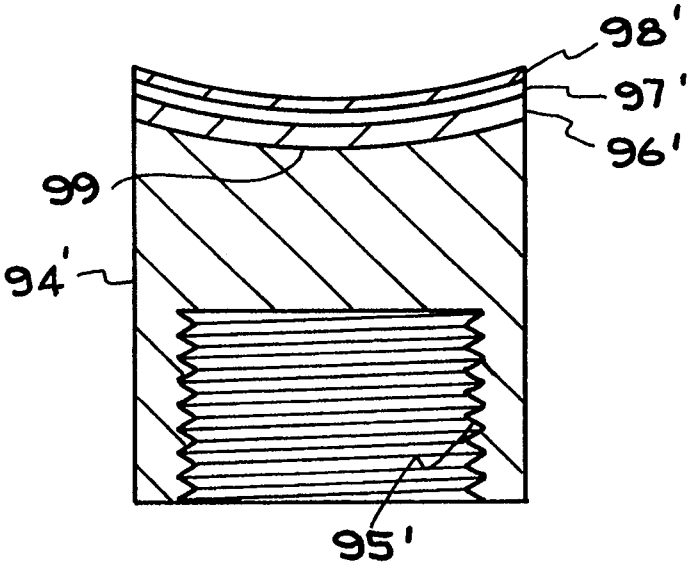
FIGS. 9 and 10 are enlarged views of different embodiments of the unique source button of FIGS. 7 and 8.
Figure 9:
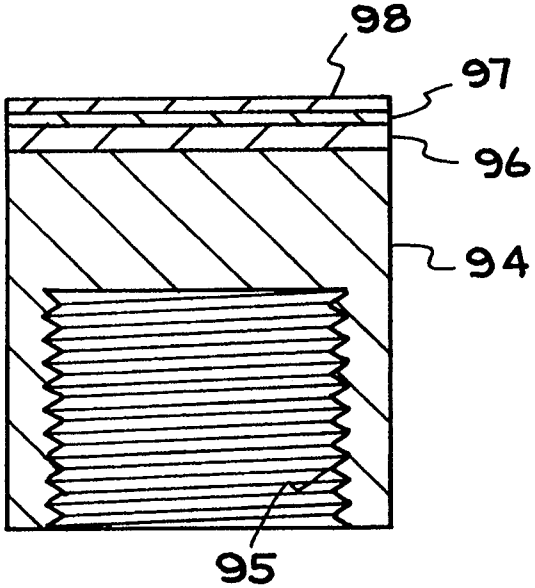

While, as pointed out above, the analyzer/detector assembly 13 (illustrated in detail in FIGS. 2–4 ) may be utilized with any suitable electron source or gun 12, as indicated in FIG. 1, two embodiments of improved electron sources are illustrated in FIGS. 5–10 with a first embodiment schematically illustrated in FIG. 5 and 6 and the second embodiment being illustrated in enlarged detail in FIGS. 7 and 8, with embodiments of the source buttons being shown in detail in FIGS. 9 and 10. The first improved electron source embodiment is generally indicated at 30, in FIGS. 5 and 6 and includes a housing or casing 31 mounted in a cylindrical or tubular coupler 32, a washer 33, a threaded retainer 34 and a knurled nut 35; with a groove 36 in coupler 32 for an o-ring 37 located between the housing 31 and coupler 32. Coupler 32 is configured to receive an end section of upper (top) end electrode or cap 18 of analyzer/detector unit 13, as seen in FIG. 1, and includes a plurality of openings 38, in an open end section 39, as seen in FIG. 5, in which retainer screws, not shown, are positioned to secure coupling 32 to cylindrical analyzer/detector assembly or unit 13. Coupler 32 also includes in open end section 39 a groove 40 in which an o-ring or other seal, not shown, is located to prevent leakage around the top end of analyzer/detector assembly 13 when positioned in end section 39 of the coupler 32. Housing or casing 31, as seen in FIG. 5 is provided with a central opening 41 into which extend source electrical power wires or leads 42 and 43 and a gas inlet line or tube 44. For example, the power wires 42 and 43 may be 0.005 inch diameter copper wires and the gas inlet line 44 may be a 0.020 inch diameter aluminum or stainless steel tube, with the coupler 32 being formed from stainless steel with the end opening 39 having a 1.0 inch internal diameter and a 1.2260 inch external diameter. The electron source or gun 30 is of a tunneling type with an electron flux density of $\sim 10^6/mm^2$ with an acceleration potential of 90 vdc.

As seen in FIGS. 5 and 6, the electron gun 30 includes an extractor assembly, generally indicated at 45, and adapted to mounted at an inner end 46 of housing 31. Extractor assembly 45 is provided with openings 47, 48 and gas fill port 49 (see FIG. 6), through which power wires or leads 42 and 43 and gas inlet line 44, respectively, which extend through end section 46 of housing 31 for connection to extractor assembly 45. The extractor assembly 45 includes an extractor cone 50, a cone voltage ring, not shown, adapted to be connected to power lead 42, a centrally located source button 52 adapted to being connected to power lead 43, and a top connector assembly, not shown, adapted to be connected to gas inlet line 44. Extractor 50 is provided with gas fill port 49 and a central opening 53 through which electrons pass into to analyzer/detector assembly 13 to ionize gas samples passed through the gas fill port 49 from gas inlet line 44.

By way of example, the housing 31 may be constructed of quartz, the extractor cone 50 made of copper, the cone voltage ring made of copper, the button source 52 made of aluminum, with thin layers of selected materials on the upper end as described hereinafter with respect to FIGS. 9 and 10, and the top connector assembly may be constructed of copper.

The electron source or gun 30 is based on electron emission. The concept of electron emission from thin Al—$Al_2O_3$ structures has been experimentally shown to be a viable source of electrons in the 10 v regime. This device operates in the low voltage, low current area where conventional filament sources are not appropriate due to their inherent high power requirements and high heat load. Because the entire mass spectrometer is battery operated the tunneling type source, with its low power requirements and its capability to be gated in a very rapid fashion is an ideal candidate. Electron fluxes on the order of $10^{100}/mm^2$ are typical for this type of source at pressures of $<5\times10^{-6}$ torr.

The typical emitter cell structure is comprised of a layer of Al1100, $Al_2O_3$, and Au. All layers are deposited by Ion Sputtering techniques onto a quartz substrate of 0.500" diameter ×0.062" thickness. The A1 layer in our application is 0.040" in width, 0.187" in length, and 1100 Å thick. On top of and aligned with this layer, a thin layer, 80 Å, of $Al_2O_3$ is applied. Perpendicular to the Al and the $Al_2O_3$ layer and at its end, a layer of 180 Å in thickness ×0.187" in length Au is deposited. Electrodes are attached to the ends of the layers at the end farthest from the junction. The unit is then placed into the vacuum environment at pressures of $<10^{-6}$ torr. Potentials applied to the source are as follows: Au layer, ground, Al , $Al_2O_3$ layers, −10 v.

The principles of operation are well founded and described elsewhere. See: C. A. Mead, J. Appl. Phys. 32, 646 (1961), J. P. Spratt, R. F. Schwarz, and W. M. Kane, Phys. Rev. Letters 6, 341 (1961), H. Kanter and W. A. Feibelman, J. Appl. Phys. 3580, (1962), and others.

Referring now to FIGS. 7 and 8, a second and preferred embodiment of an improved electron source is illustrated, and includes some components generally similar to those of the embodiment of FIGS. 5 and 6. The FIGS. 7 and 8 embodiment of the electron source, generally indicated at 60 includes a housing or casing 61 having an opening 62, a flanged outer end 63, and an open inner end 64 in which an end piece or member 65, made of glass or other insulative material, is located. An extractor assembly generally indicated at 66 is secured to inner end 64 of casing 31 with components thereof abutting with or extending through end piece 65. Extractor assembly 66 includes a cone or cover 67 having a central opening 68 and an adjacent, but smaller diameter, opening or port 69. Located within cone 67 and in abuttment with end piece 65 is a hollow member or voltage ring 70. A source button 71 is located centrally within cone 67 and in axial alignment with the central opening 68 of the cone, and is retained against end piece 65 by a movable retainer or member 72 which in turn is movably mounted to a support or collar 73 secured through end piece 65 by an attachment member 74 which extends through an opening 75 in end piece 65. Source button 71 is secured to end piece 65 via a screw or attachment member 76 which extends through an opening 77 in end piece 65 and into a threaded opening 78 in source button 71, as described in greater detail with respect to FIGS. 9 and 10. A layer 79 of insulative material is located on the opposite side of end piece 65 and is provided with holes or openings 80, 81, 82 and 83. A bias wire 84 extends through opening 62 of casing 61, opening 80 in layer 79, an opening or hole 85 in end piece 65, and is electrically connected to voltage ring 70. A gas inlet line or fill tube 86 extends through opening 62 of casing 61, opening 81 in layer 79, an opening or hole 87 in end piece 65, and fill port or opening 69 in extractor cone 67. A pair of source power leads or wires 88 and 89 extend through casing opening 62 and are electrically secured respectively to attachment members 74 and 76, which extend through openings 83 and 82, respectively, in layer 79 and through holes or openings 75 and 77 in end piece 65. Note that attachment member 74 is of a double-screw type, whereby one end or screw section 90, which extends through retainer 72 and collar 73 can be loosened without affecting the electrical connection between source power wire or lead 88 with attachment member 74. Also, note that collar 74 and source button 71 are mounted so as to define a space 91 therebetween, which allow movement of the retainer 72 from over source button 71 whereby the source button 71 can be easily removed and/or replaced. Also, retainer 72 includes an opening 92 in axially alignment with central opening 68 in extractor cone 67, whereby electrons from the source button, as indicated by the arrow, can readily pass through openings 92 and 68 into analyzer/detector assembly 13 to ionize gas samples passing through the gas fill port 69 from the gas inlet line 86.

In FIGS. 7 and 8 typical wall thicknesses are 0.030" for all borosylicate type materials. The Cu and Al structures are usually 0.020"–0.025" wall thickness with threaded portions typically being 80 threads per inch. Other tubulation materials may be quartz, macor, nylon, teflon, or delrin for the source housing. The electrode components may be constructed of Cu, SS, Al , or Ni. The current configuration is machined for structural integrity and light weight. Typical wall thicknesses are on the order of 0.015"–0.018". All press fit segments are to tolerance 'F1'–'F2'. Potting solutions can be of any high dielectric strength material which exhibits good UHV (Ultra High Vacuum) characteristics. The current potting material is, 'Torr Seal' manufactured by Varian and Associates, Palo Alto, Calif. The grid screening material utilized at the down stream side of the electron source is 80% transmissive Au mesh. This can also be W, SS, or Cu. Typical mesh thickness is 0.001". Interior components which are subjected to the vacuum environment and requiring electrical contact are adhered with silver conductive epoxy. Wire leads may be of any convenient thickness and material. The gas inlet line is SS typ 304. Al could be utilized as well as Cu. In the GCMS (Gas Chromatograph Mass Spectroscopy) configuration Cu would be the material of choice due to its heat transfer characteristics. In no instance would brass be considered for any internal part exposed to vacuum due to its poor outgassing characteristics.

FIGS. 9 and 10 illustrate embodiments of the button source 42 or 71 of the electron source or guns 30 or 60 of FIGS. 5–6 and 7–8. The button source of each of the embodiments includes a body 94 and 94' constructed of copper, aluminum, stainless steel, or iron, having a threaded opening 95 and 95' in one end (similar to opening 78 in FIGS. 7–8) and a plurality of thin layers of selected materials on the opposite end. In these embodiments, the body 94 and 94' is preferably made of aluminum and the three (3) layers 96–96'', 97–97' and 98–98' consist of the layer 96–96' being composed of aluminum (Al) having a thickness of 1,100 Å, the layer 97–97' composed of aluminum oxide ($Al_2O_3$) having a thickness of 80 Å, and the layer 98–98' composed of gold (Au) having a thickness of 180 Å. The body 94–94' of each of the embodiments has a height of 0.080 inch and diameter of 0.080 inch, and in FIG. 9 the threaded opening 95 has a depth of 0.050 inch and thread of 0–80, while the opening 95' of FIG. 10 has a depth of 0.040 inch and thread of 0–80. The body 94' of the FIG. 10 embodiment is provided with a concave end 99 on which the layers 62–64 are deposited, with the concave having a radius of 0.131 inch. Other materials and thickness may be utilized in layers 96–96', 97–97' and 98–98'. The thickness of each layer is determined by the required emission characteristics and power requirements. Known mathematical formulas are utilized in this decision making process. See: Fowler-Nordheim formula which describes the tunneling current between two layers, Schottky's theory of thermal emission over a Barrier, and Blochs Theorem concerning the wave function of an electron in a crystal.

The mass spectrometer 10 functions in the following manner:

1). Inlet a gas sample, 1 ms pulse rate on inlet valve.
2). Turn on source gate.
3). Ionize gas sample.
4). Turn on compensation and end cap rings. (Close trap)
5). Begin ion excitation sequence.
6). Stop ion excitation sequence.
7). Begin ion detect sequence.
8). End ion detect sequence.
9). Turn off compensation rings. (Open trap)
10). Eject ions from trap.
11). Begin new sequence.

It has thus been shown that the mini ion trap mass spectrometer of this invention enables for example, the detection of environmental pollutants or illicit substances, as well as for monitoring engine performance. Due to the small size of the mass spectrometer overall system as shown in FIG. 1, it can be easily transported by hand to even very remote locations. For example, the embodiment illustrated in FIG. 1 has an overall length of 13.2 inch, with the mass spectrometer section 10 being 6.2 inch in length, the ion pump section 16 being 3.0 inch across, with the isolation tube 14/cryogenic pump 15 having a length of 4.0 inch. The magnetic 11 has a length of 2.3 inch and a diameter of 4.0 inch. The analyzer/detector assembly 13 has a length of 4.2 inches and an external width of 1 inch, with the central trapping electrode or anode 22 having a length (left-to-right) of 0.1066 inch and a height of 0.811 inch.

The compensation electrodes or rings 21 and 22 have a length of 0.3187 inch and a height of 0.811 inch, with end caps or electrodes 18 and 19 having a length of 1.7137 inch. The ring electrodes 20 and 21 are each spaced from their associated end electrodes 18 and 19 and from central electrode 22 by a distance of 0.0120 inch. The analyzer/detector assembly 13 is made from 1.0 inch diameter tube of MACOR with an internal diameter of 0.811 inch, and the electrodes 18–21 are formed on the interior surface of the tube, with the segmented central electrode machined within the tube as shown in FIG. 4. The improved electron source is of the tunneling type and has an electron flux density of $\sim 10^6/mm^2$ with an acceleration potential of 90 vdc, and includes a source button having thin layers of selected material thereon.

While a particular embodiment has been illustrated with specific materials, parameters, etc. set forth to provide an understanding of the principle features and operation of the invention, such are not intended to be limiting. Modifications and changes will become apparent to one skilled in the art, and it is intended that the invention be limited only by the scope of the appended claims.

We claim:

1. A portable ion trap mass spectrometer which includes an electron source, mass analyzer and ion detector assembly combined into a single device and mounted in a hollow permanent magnet.

2. The mass spectrometer of claim 1, wherein said mass analyzer/ion detector assembly includes a central electrode, a pair of ring electrodes positioned adjacent said central electrode, and a pair of end electrodes positioned adjacent said ring electrodes.

3. The mass spectrometer of claim 2, wherein said central electrode is composed of a plurality of segments.

4. The mass spectrometer of claim 3, wherein the plurality of segments consist of alternating excite and detect segments.

5. The mass spectrometer of claim 3, wherein said central electrodes, ring electrodes, and said end electrodes are located within a cylindrical shaped member.

6. The mass spectrometer of claim 5, wherein said cylindrical shaped member is composed of a ceramic material.

7. The mass spectrometer of claim 5, wherein said cylindrical shaped member is provided with a plurality of grooves on the external surface thereof and an opening at one end of each groove to provide for electrical contact for the electrodes within said cylindrical shaped member.

8. The mass spectrometer of claim 1, wherein said electron source is of a tunneling type.

9. The mass spectrometer of claim 1, wherein said electron source includes a housing having an extractor cone located at one end of said house, said extractor cone having therein a cone voltage ring, a source button, and a top connector assembly.

10. The mass spectrometer of claim 9, wherein said housing is additionally provided with electrical leads and a gas inlet line mounted therein to cooperate with said cone voltage ring, source button and top connector assembly.

11. The mass spectrometer of claim 9, wherein said source button includes a body having an opening in one end and provided with a plurality of layers of material on the opposite end.

12. The mass spectrometer of claim 11, wherein said opposite end of said body has a concave configuration.

13. The mass spectrometer of claim 11, wherein said body is constructed from material selected from the group consisting of quartz, copper, stainless steel, and aluminum.

14. The mass spectrometer of claim 11, wherein said plurality of layers of material are composed of layers of Al, $Al_2O_3$, and Au.

15. The mass spectrometer of claim 1, wherein said hollow permanent magnet is of a cylindrical configuration.

16. In a mass spectrometer, the improvement comprising a cylindrical analyzer/detector assembly having a pair of end electrodes, a pair of ring electrodes located adjacent the end electrodes, and a central trapping electrode located intermediate said ring electrodes and composed of alternating excite and detect segments.

17. The improvement of claim 16, wherein said central trapping electrode includes at least two excite segments and two detect segments.

* * * * *